US009464810B2

(12) United States Patent
Genin et al.

(10) Patent No.: US 9,464,810 B2
(45) Date of Patent: Oct. 11, 2016

(54) BURNER INCLUDING A SWIRL CHAMBER WITH SLOTS HAVING DIFFERENT WIDTHS

(71) Applicant: ALSTOM Technology Ltd, Baden (CH)

(72) Inventors: Franklin Marie Genin, Baden (CH); Marcel Rieker, Niedergösgen (CH); Stefano Bernero, Oberrohrdorf (CH); Bettina Paikert, Oberrohrdorf (CH); Ewald Freitag, Baden (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 311 days.

(21) Appl. No.: 14/059,876

(22) Filed: Oct. 22, 2013

(65) Prior Publication Data

US 2014/0109583 A1 Apr. 24, 2014

(30) Foreign Application Priority Data

Oct. 22, 2012 (EP) ..... 12189388

(51) Int. Cl.

| | |
|---|---|
| ***F23R 3/14*** | (2006.01) |
| ***F23R 3/28*** | (2006.01) |
| ***F23R 3/34*** | (2006.01) |
| ***F23D 11/40*** | (2006.01) |

(52) U.S. Cl.

CPC ..... *F23R 3/286* (2013.01); *F23D 11/402* (2013.01); *F23R 3/14* (2013.01); *F23R 3/343* (2013.01); *F23C 2900/07001* (2013.01); *F23C 2900/07002* (2013.01)

(58) Field of Classification Search

CPC ..... F23R 3/286; F23R 3/14; F23R 3/343; F23R 3/12; F23D 11/40; F23D 11/402; F23C 2900/07001; F23C 2900/07002

USPC ..... 60/737, 738, 748, 740, 742, 734; 431/8, 431/9, 181–188, 350–354

See application file for complete search history.

(56) References Cited

U.S. PATENT DOCUMENTS

| | | | | |
|---|---|---|---|---|
| 5,588,826 | A * | 12/1996 | Dobbeling | F23D 17/002 239/402 |
| 6,019,596 | A * | 2/2000 | Knopfel | F23C 7/002 431/350 |
| 6,027,331 | A * | 2/2000 | Dobbeling | F23C 7/002 431/182 |
| 6,640,545 | B2 * | 11/2003 | Ruck | F23C 7/002 60/737 |
| 6,702,574 | B1 * | 3/2004 | Dobbeling | F23C 7/002 239/403 |
| 2005/0115244 | A1 * | 6/2005 | Griffin | F23R 3/286 60/737 |

FOREIGN PATENT DOCUMENTS

| | | |
|---|---|---|
| CN | 1162089 A | 10/1997 |
| CN | 102628596 A | 8/2012 |
| DE | 195 45 310 | 6/1997 |
| DE | 196 54 008 | 6/1998 |
| EP | 0 694 730 | 1/1996 |
| EP | 0 783 089 | 7/1997 |
| EP | 0 918 191 | 5/1999 |
| WO | 2009/068424 | 6/2009 |
| WO | 2009/109452 | 9/2009 |

* cited by examiner

*Primary Examiner* — Steven Sutherland

(74) *Attorney, Agent, or Firm* — Buchanan Ingersoll & Rooney PC

(57) ABSTRACT

The burner includes a swirl chamber. The swirl chamber has a substantially conical shape defining a central axis. The swirl chamber is defined by a plurality of wall elements. A combination of nozzles at the pressure, suction side and trailing edge of the wall element are placed for fuel injection. The wall elements define slots between each other. The slots have different widths (w) in consecutive planes in the axial direction, wherein said planes are perpendicular to the central axis.

5 Claims, 4 Drawing Sheets

BURNER INCLUDING A SWIRL CHAMBER WITH SLOTS HAVING DIFFERENT WIDTHS

CROSS-REFERENCE TO RELATED APPLICATIONS

This application claims priority to European application 12189388.7 filed Oct. 22, 2012, the contents of which are hereby incorporated in its entirety.

TECHNICAL FIELD

The present disclosure relates to a burner.

In particular the burner is a premixed burner (i.e. a burner arranged to generate a premixed flame); for example this premixed burner can be used in a gas turbine.

BACKGROUND

Premixed burners known from the state of the art have a swirl chamber and a lance for introducing a fuel into the swirl chamber.

Traditional swirl chambers can be defined by sector plates connected one beside the other in order to define the swirl chamber having a conical shape.

In addition, between adjacent sector plates, slots with a constant width along the axial span of the swirler are defined for introducing an oxidiser, such as air, into the swirl chamber. With other words, those slots have constant widths in consecutive planes in axial direction, wherein these planes are perpendicular to the central axis of the burner.

Close to the slots, also supply pipes (typically provided with nozzles) for fuel supply are also provided.

These premixed burners proved to have good performances, anyhow the mixture of oxidiser and fuel formed in the swirl chamber in some conditions could not be optimised.

Mixture optimization is very important in a premixed burner, because it influences the quality of the combustion that occurs in a combustion chamber typically connected downstream of the burner (with respect to the combusted gas flow).

SUMMARY

An aspect of the disclosure includes providing a burner with improved mixing of oxidiser, such as air, and fuel (either liquid or gaseous fuel).

These and further aspects are attained by providing a burner in accordance with the accompanying claims. Preferably, according to the disclosure a burner with controlled discharge flow and improved mixing of oxidizer and fuel can be provided

BRIEF DESCRIPTION OF THE DRAWINGS

Further characteristics and advantages will be more apparent from the description of a preferred but non-exclusive embodiment of the burner, illustrated by way of non-limiting example in the accompanying drawings, in which.

DETAILED DESCRIPTION

Figure 1:
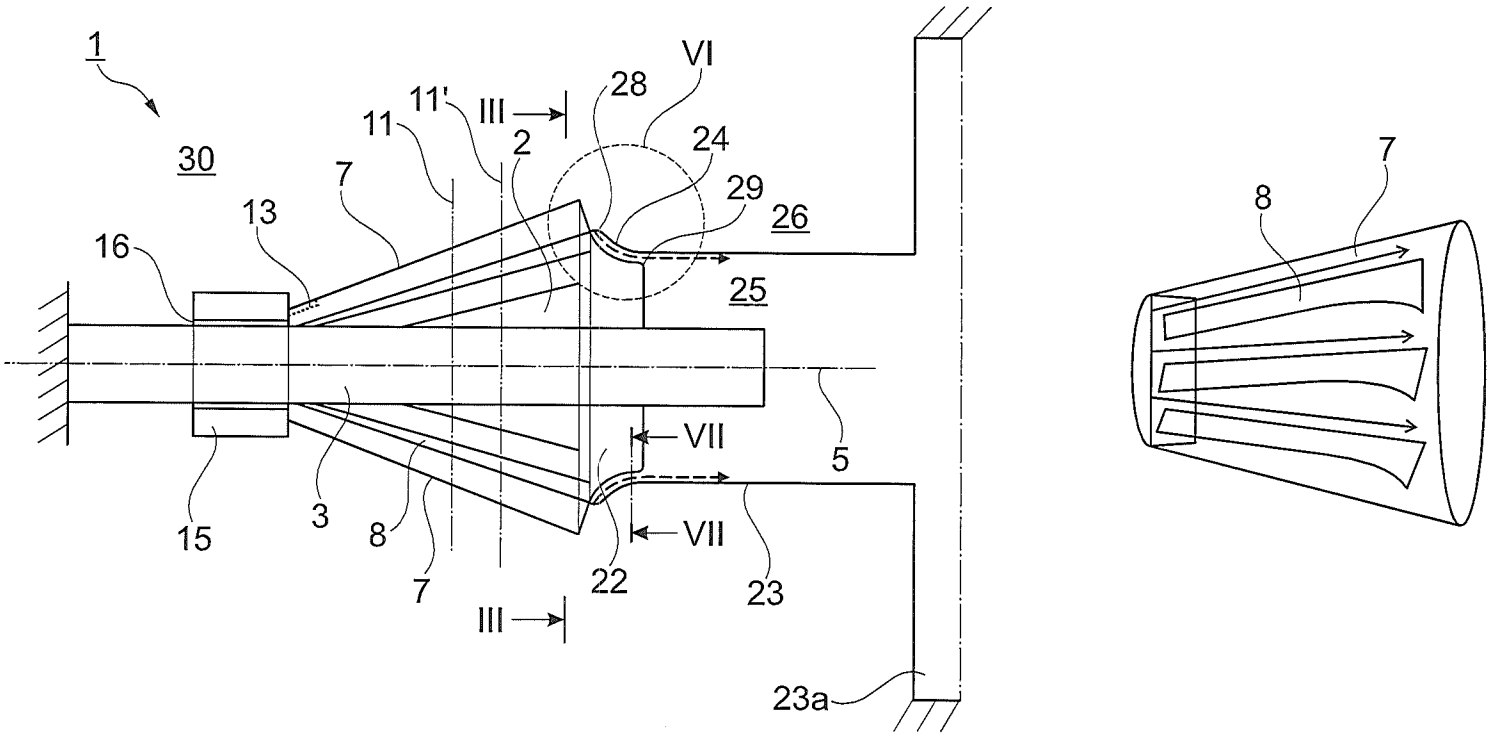
FIG. 1*a*, 1*b* are schematic views of a burner in an embodiment of the invention.

With reference to the figures, these show a burner 1 (preferably a premixed burner) comprising a swirl chamber 2 and a lance 3 in the swirl chamber 2. The lance 3 is shown in FIG. 1*a* as extending more than the swirl chamber 2, but in different embodiments the lance can be shorter than the swirl chamber axial length and thus the end on the lance 3 can be housed in the swirl chamber 2.

The swirl chamber 2 has a substantially conical shape and defines a central axis 5.

The swirl chamber 2 is defined by a plurality of wall elements 7 that are connected one beside the other and that define slots 8 between each other. This can be seen in the schematic perspective view of FIG. 1*b*.

According to the present invention the slots 8 have different width w in the axial direction in consecutive planes 11, 11' perpendicular to the central axis 5. That means they have varying widths along the axial span of the swirl chamber, the axial direction being defined by the central axis 5. The characteristics of the slots width variations along the span of the swirler are defined to enable the control of the air flow distribution through the swirler slots and to obtain a prescribed discharge flow characteristics.

Figure 4:
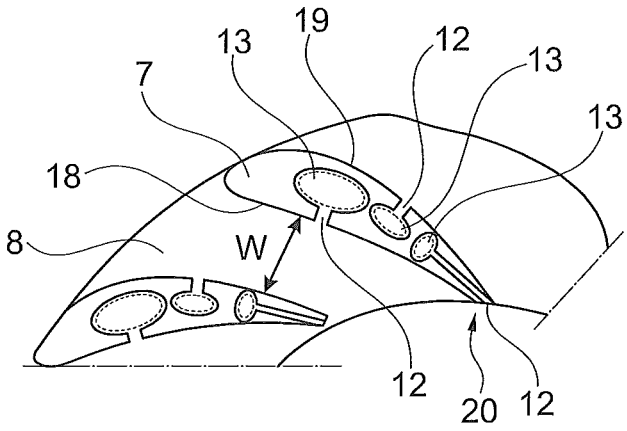
FIGS. 4 and 5 show two different embodiments of wall element and slots defined by them.
Figure 5:
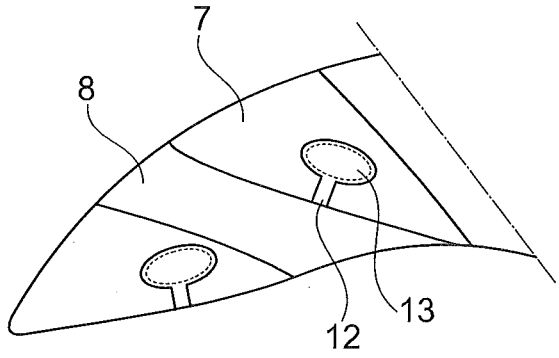

As can be seen in FIG. 4, the wall elements 7 define a pressure side 18, a suction side 19 and a trailing edge 20. At least some of the wall elements 7 comprise nozzles 12 (FIG. 4, FIG. 5), the nozzles 12 are located at the pressure side 18 and/or at the suction side 19 and/or at the trailing edge 20.

Figure 3:
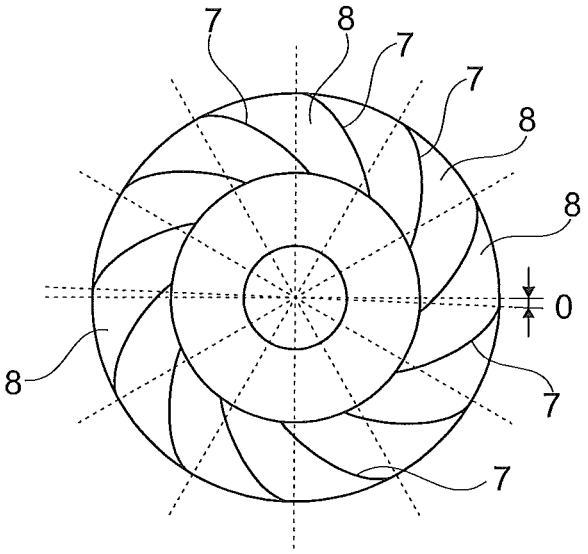
FIG. 3 is a cross section through line of FIG. 1*a;*

Preferably, the wall elements 7 are airfoil elements that can have an overlap o (see FIG. 3) between the trailing edge of a wall element 7 and the leading edge of another wall element 7 or not.

Figure 2:
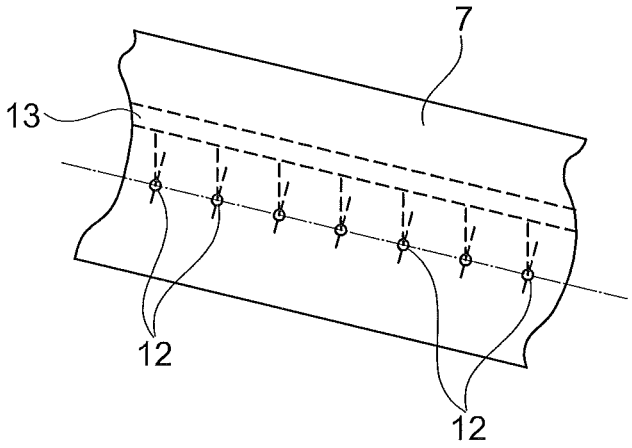
FIG. 2 shows the fuel nozzles at the wall elements.

In addition, at least some of the wall elements 7 have nozzles 12 for fuel injection and a supply circuit 13 for the nozzles 12 (see FIG. 2, 4, 5). The nozzles 12 are connected to the supply circuits 13. In a preferred embodiment, the supply circuits 13 of the nozzles located on one side of the wall elements 7 are connected to separate supply circuits than nozzles located on another side of the wall elements. The supply circuits 13 can have (when required) insert for thermal insulation.

The burner 1 also has a collector 15 connected to the supply circuits 13 (see FIG. 1*a*).

The collector 15 has an annular shape and is located at the smaller end of the swirl chamber 2.

In another embodiment the collector 15 has separate and isolated chambers, connected to separate supply circuits 13.

According to FIG. 1*a* the collector 15 has a diameter larger that the lance diameter such that a gap 16 is defined at the area of the apex of the swirl chamber 2; through this gas 16 (when provided) air can enter the swirl chamber 2.

The burner 1 also has a transition element 22 at the larger end of the swirl chamber 2. In addition, a mixing tube 23 is connected to the transition element 22. The mixing tube 23 is then connected to a combustion chamber 23*a* where combustion of the mixture formed in the burner occurs (FIG. 1*a*).

A passage 24 is provided between the transition element 22 and the mixing tube 23. Details of the passage 24 are shown in FIG. 6*a*, 6*b*, 6*c* and FIG. 7.

The passage 24 connects the inside 25 to the outside 26 of the mixing tube 23.

For example, an inlet 28 of the passage faces the outside 26 of the mixing tube 23 and swirl chamber 2 and the outlet 29 of the passage 24 faces the inside 25 of the mixing tube 23.

The passage 24 is preferably arranged to eject a flow substantially parallel to a mixing tube surface; this counteract flashbacks, because the greatest risk of flashbacks occurs at zones close to the mixing tube surface.

The transition element 22 has a larger end facing the swirl chamber 2 and a smaller end facing the mixing tube 23; The mixing tube 23 can be an integral part of the combustion chamber front panel, or a separate element pre assembled with the combustion chamber front panel.

In the described arrangement, the swirler and mixing tube are assembled when the swirler is inserted, using the sliding joint described above, easing the assembly and disassembly of the burners in the engine.

Figure 6:
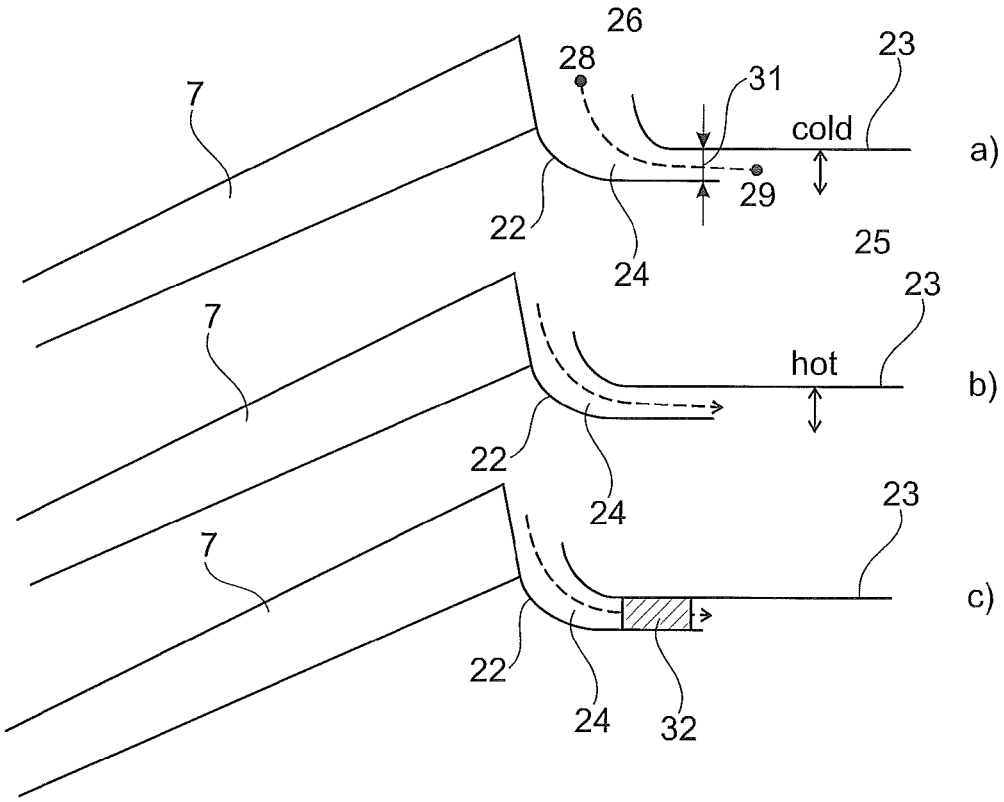
FIG. 6*a*, 6*b*, 6*c* show in an enlarged view details of the passage 24 of FIG. 1
Figure 7:
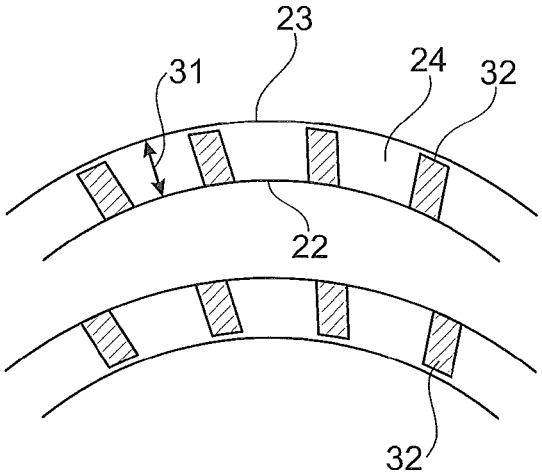
FIG. 7 is a cross section through line VII-VII of FIG. 1.

In a preferred embodiment the passage 24 has an axial extent which exceeds axial movement of the mixing tube and swirler due to thermal expansion. Referring to FIG. 6*a,b* the flow ejected through passage 24 is controlled by the radial width 31 of the passage 24. The described arrangement ensures a control of the purge flow going through the passage 24.

In an alternative embodiment (see FIG. 6*c* and FIG. 7), in the passage 24 spacers 32 are included on the surface of the mixing tube and/or the swirler, to avoid eccentricity of the two parts while still allow sliding and air passage. These spacers 32 may be aligned in axial direction or tilted in order to control the swirl of the purge flow, e.g to optimize flashback performance.

The operation of the burner is apparent from that described and illustrated and is substantially the following.

When installed for example in a gas turbine the burner 1 is housed in a plenum 30 that during operation contains high pressure air.

Air from the plenum passes through the slots 8 and enters the swirl chamber 2.

Since wall elements 7 are shaped like airfoils and the slots 8 have different widths in the axial direction consecutive planes 11, 11' the planes are perpendicular to the central axis, the characteristics of the flow of the air through the slots 8 can be controlled at given axial, and equivalently radial, position within the slot 8. For example the air velocity can be regulated according to the conditions existing within the swirl chamber 2. This allows an optimisation of the mixing within the swirl chamber 2 and/or optimization of the flow field at the inlet of the combustion chamber 23*a*.

In addition, the nozzles 12 which inject fuel over large surfaces further help mixing. The combination of injection nozzles 12 from pressure sides 18, suction sides 19 and trailing edge 20 permits to control the fuel distribution in a prescribed manner, in accordance with the air flow distribution obtained from the varying slot widths.

The operation of the burner 1 of the present disclosure is thus more efficient and allows lower pulsations, CO and NOx generation.

Naturally the features described may be independently provided from one another.

In practice the materials used and the dimensions can be chosen at will according to requirements and to the state of the art.

The invention claimed is:

1. A burner comprising:

a swirl chamber having a conical shape defining a central axis;

the swirl chamber including a plurality of wall elements;

the plurality of wall elements define a pressure side, a suction side and a trailing edge, wherein at least some of the plurality of wall elements include nozzles for fuel injection, said nozzles are located at at least one of the pressure side, the suction side, and the trailing edge, the plurality of wall elements define slots between each other, wherein the slots have different widths (w) in consecutive planes in an axial direction, and the consecutive planes are perpendicular to the central axis;

a transition element at a larger end of the swirl chamber and a mixing tube connected to the transition element, the transition element and the mixing tube being manufactured in separate elements and connected together, a passage provided between the transition element and the mixing tube; and an inlet of the passage faces an outside of the mixing tube and the swirl chamber and an outlet of the passage faces an inside of the mixing tube, wherein the passage is arranged to eject a flow through it, parallel to a surface of the mixing tube, wherein an axial location of the outlet of the passage and radial gap of the passage are fixed to ensure a controlled flow through the passage at all operating conditions.

2. The burner according to claim 1, wherein the plurality of wall elements are airfoil elements.

3. The burner according to claim 1, wherein spacers are arranged in the passage on the surface of the mixing tube and/or a surface of the transition element to avoid eccentricity of the mixing tube and the transition element while still allowing relative movement and air passage.

4. The burner according to claim 3, wherein the spacers are axially tilted in order to control a swirl of a purge flow to a desired value.

5. The burner according to claim 1, wherein at least some of the plurality of wall elements include nozzles for fuel injection located at the trailing edge of the at least some of the plurality of wall elements.

* * * * *